US006565672B2

(12) United States Patent
Spitsberg et al.

(10) Patent No.: US 6,565,672 B2
(45) **Date of Patent: *May 20, 2003**

(54) FABRICATION OF AN ARTICLE HAVING A PROTECTIVE COATING WITH A FLATTENED, PRE-OXIDIZED PROTECTIVE-COATING SURFACE

(75) Inventors: Irene Spitsberg, Loveland, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/944,706

(22) Filed: Aug. 31, 2001

(65) Prior Publication Data

US 2003/0041927 A1 Mar. 6, 2003

(51) Int. Cl.[7] ..... C23C 8/80

(52) U.S. Cl. ..... 148/277; 198/285; 427/248.1; 427/250; 427/255.32; 428/623; 428/469; 428/472.2

(58) Field of Search ..... 148/240, 277, 148/285; 427/248.1, 250, 255.32; 428/623, 469, 472.2

(56) References Cited

U.S. PATENT DOCUMENTS 4,414,249 A * 11/1983 Ulion et al. ..... 205/661

* cited by examiner

*Primary Examiner*—John Sheehan
*Assistant Examiner*—Andrew L. Oltmans
(74) *Attorney, Agent, or Firm*—Gregory Garmong; Carmen Santa Maria McNees Wallace & Nurick LLC

(57) ABSTRACT

An article protected by a protective coating system is fabricated by providing an article substrate having a substrate surface; and thereafter producing a protective coating having a flattened, pre-oxidized protective-coating surface on the substrate surface by depositing a protective coating on the substrate surface, the protective coating having a protective-coating surface, processing the protective coating to achieve a flattened protective-coating surface, and controllably oxidizing the protective-coating surface. A thermal barrier coating may be deposited overlying the flattened, pre-oxidized protective coating.

22 Claims, 4 Drawing Sheets

FABRICATION OF AN ARTICLE HAVING A PROTECTIVE COATING WITH A FLATTENED, PRE-OXIDIZED PROTECTIVE-COATING SURFACE

This invention relates to protective systems such as used to protect some components of gas turbine engines and, more particularly, to the treatment of the protective-coating surface.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high-temperature capabilities have been achieved through the formulation of nickel- and cobalt-base superalloys. Nonetheless, when used to form components of the turbine, combustor and augmentor sections of a gas turbine engine, such alloys alone are often susceptible to damage by oxidation and hot corrosion attack and may not retain adequate mechanical properties. For this reason, these components are often protected by an environmental and/or thermal-insulating coating, the latter of which is termed a thermal barrier coating (TBC) system. Ceramic materials and particularly yttria-stabilized zirconia (YSZ) are widely used as a thermal barrier coating (TBC), or topcoat, of TBC systems used on gas turbine engine components. The TBC employed in the highest-temperature regions of gas turbine engines is typically deposited by electron beam physical vapor deposition (EBPVD) techniques that yield a columnar grain structure that is able to expand and contract without causing damaging stresses that lead to spallation.

To be effective, TBC systems must have low thermal conductivity, strongly adhere to the article, and remain adherent throughout many heating and cooling cycles. The latter requirement is particularly demanding due to the different coefficients of thermal expansion between ceramic topcoat materials and the superalloy substrates they protect. To promote adhesion and extend the service life of a TBC system, an oxidation-resistant bond coat is usually employed. Bond coats are typically in the form of overlay coatings such as MCrAlX (where M is iron, cobalt, and/or nickel, and X is yttrium or another rare earth element), or diffusion aluminide coatings. A notable example of a diffusion aluminide bond coat contains platinum aluminide (NiPtAl) intermetallic. When a bond coat is applied, a zone of interdiffusion, termed a diffusion zone, forms between the substrate and the bond coat. The diffusion zone beneath an overlay bond coat is typically much thinner than the diffusion zone beneath a diffusion bond coat.

During the deposition of the ceramic TBC and subsequent exposures to high temperatures, such as during engine service, bond coats of the type described above oxidize to form a tightly adherent alumina (aluminum oxide or $Al_2O_3$) layer or scale that protects the underlying structure from catastrophic oxidation and also adheres the TBC to the bond coat. The service life of a TBC system is typically limited by spallation at or near the interfaces of the alumina scale with the bond coat or with the TBC. The spallation is induced by thermal fatigue as the article substrate and the thermal barrier coating system are repeatedly heated and cooled during engine service.

There is a need for an understanding of the specific mechanisms that lead to the thermal fatigue failure of the protective system, and for structures that extend the life of the coating before the incidence of such failure. The present invention fulfills this need, and further provides related advantages.

BRIEF SUMMARY OF THE INVENTION

The present invention provides an approach for fabricating an article protected by a protective system, and articles protected by the protective system. The life of the protective system is extended under conditions of thermal fatigue by delaying the onset of the protective coating/alumina scale convolution failure mode and also by slowing the growth of the alumina scale and by delaying the onset of the alumina-scale interface failure mode. The present approach is applicable to environmental-coating protective systems where there is no thermal barrier coating present. However, it realizes its greatest advantages when used in thermal barrier coating systems where the protective coating is a bond coat and a ceramic thermal barrier coating overlies the bond coat.

A method of fabricating an article protected by a protective coating system comprises the steps of providing an article substrate having a substrate surface, and thereafter producing a protective coating having a flattened, pre-oxidized protective-coating surface on the substrate surface. The step of producing the protective coating includes the steps of depositing a protective coating on the substrate surface, the protective coating having a protective-coating surface, processing the protective coating to achieve a flattened protective-coating surface, and controllably oxidizing the protective-coating surface. Optionally but preferably, a thermal barrier coating is deposited overlying the flattened, pre-oxidized protective-coating surface.

The article substrate preferably is a nickel-base superalloy, and most preferably is a component of a gas turbine engine. The bond coat may be a diffusion aluminide bond coat such as a platinum aluminide bond coat, or it may be an overlay bond coat.

The step of processing the protective coating includes the step of flattening the protective-coating surface. The protective coating is flattened substantially without removing metal from the protective-coating surface, as by peening the protective coating. Desirably, the step of processing the protective coating produces a protective-coating surface wherein an average grain boundary displacement height of the protective coating is less than about 3 micrometers, more preferably less than about 1 micrometer, and most preferably less than about 0.5 micrometer, over at least about 40 percent of the grain boundaries of the protective coating but more preferably over all of the grain boundaries of the protective coating. In most cases, the step of processing the protective coating is performed after the step of depositing the protective coating is complete. In some cases, however, the steps of depositing the protective coating and processing the protective coating are performed concurrently. Additionally, it is preferred that at least about 40 percent, and more preferably all, of the surface of the protective coating is flattened to have a grain displacement height of less than about 3 micrometers, more preferably less than about 1 micrometer, and even more preferably less than about 0.5 micrometer. The step of processing may optionally include roughening and cleaning the protective-coating surface prior to flattening.

The step of controllably oxidizing the protective coating preferably includes the step of heating the protective coating in an atmosphere having a partial pressure of oxygen of from about $10^{-5}$ mbar to about $10^{3}$ mbar, more preferably from about $10^{-5}$ mbar to about $10^{-2}$ mbar, at an oxidizing temperature of from about 1800° F. to about 2100° F., and for a time of from about ½ hour to about 3 hours. The controllable oxidation is preferably performed by heating the protective coating to a pre-oxidation temperature of from about 2000° F. to about 2100° F. in a heating time of no more than about 45 minutes (preferably from about 1 to about 45 minutes, and more preferably from about 15 to about 35 minutes), and thereafter holding at the preoxidation temperature for a time of from about ½ hour to about 3 hours, in an atmosphere having a partial pressure of oxygen of about $10^{-4}$ mbar.

The present approach addresses two major mechanisms of thermal fatigue failure in thermal barrier coating systems. The flattening of the protective-coating surface reduces the tendency of the protective coating to form the convolutions that lead to spalling of the alumina that forms on the protective-coating surface. The controlled oxidation of the protective-coating surface improves the bond strength between the protective coating and the alumina scale, and also reduces the growth rate of the alumina scale, so that the oxide reaches its critical thickness after longer times. By forming the alumina scale by a controlled oxidation, the slowly growing alumina scale places less stresses on the bond coat/alumina scale interface. As a result, failure of the protective coating system during thermal fatigue is delayed, improving its life.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
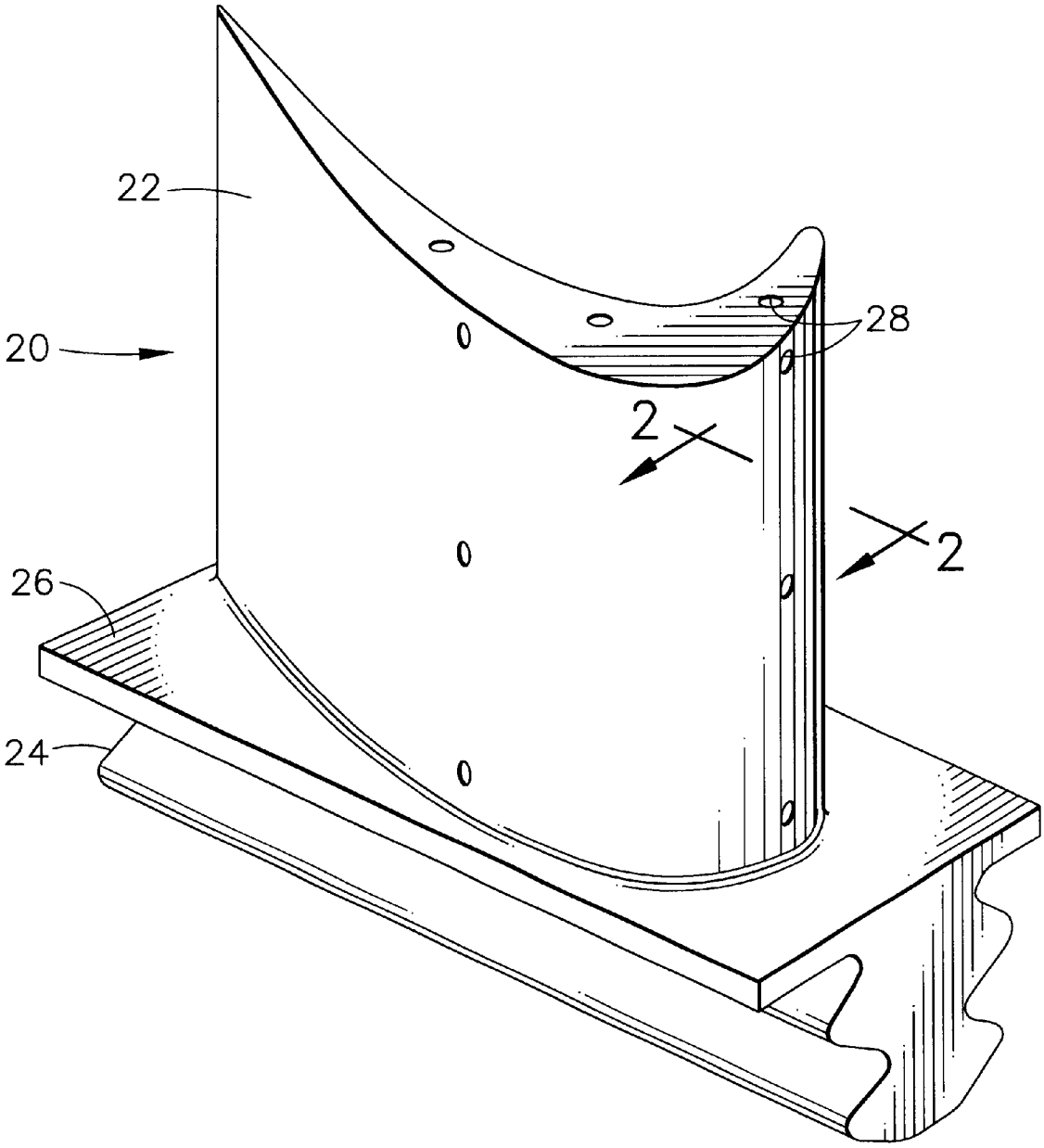
FIG. 1 is a perspective view of a turbine blade.

FIG. 1 depicts a component article of a gas turbine engine such as a turbine blade or turbine vane, and in this illustration a turbine blade 20. The turbine blade 20 is formed of any operable material, but is preferably a nickel-base superalloy. The turbine blade 20 includes an airfoil section 22 against which the flow of hot exhaust gas is directed. (The turbine vane or nozzle has a similar appearance in respect to the pertinent airfoil section, but typically includes other end structure to support the airfoil.) The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24. A number of internal passages extend through the interior of the airfoil 22, ending in openings 28 in the surface of the airfoil 22. During service, a flow of cooling air is directed through the internal passages to reduce the temperature of the airfoil 22.

Figure 2:
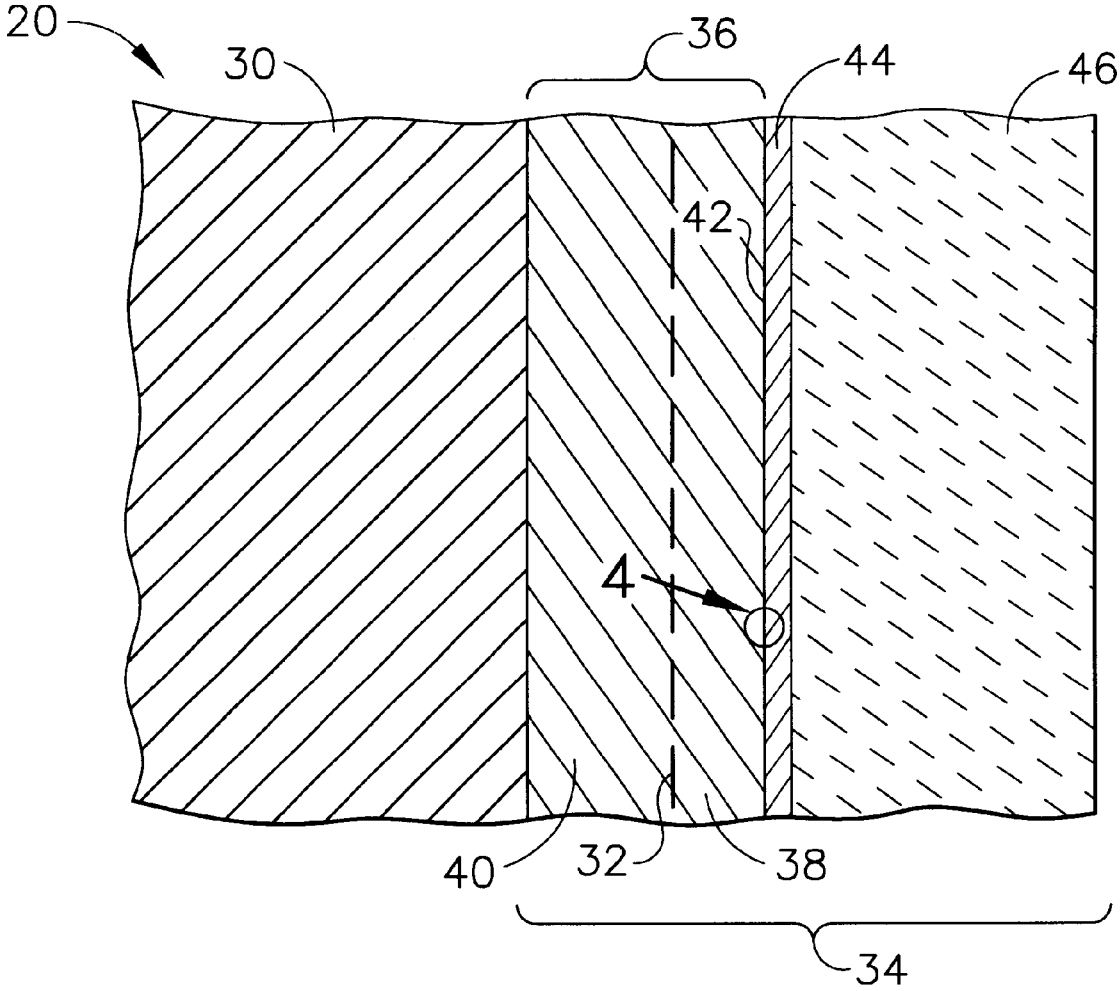
FIG. 2 is an enlarged schematic sectional view through the turbine blade of FIG. 1, taken on lines 2—2.

FIG. 2 is a schematic sectional view, not drawn to scale, through a portion of the turbine blade 20, here the airfoil section 22. The turbine blade 20 has a body that serves as a substrate 30 with a surface 32. Overlying and contacting the surface 32 of the substrate 30, and also extending downwardly into the substrate 30, is a protective coating system 34 including a protective coating 36. In the absence of an overlying ceramic thermal barrier coating, the protective coating 36 is termed an environmental coating. Where there is a thermal barrier coating, the protective coating 36 is termed a bond coat. The protective coating 36 includes an additive layer 38 and a diffusion zone 40 that is the result of interdiffusion of material from the additive layer 38 with material from the substrate 30. The process that deposits the additive layer 38 onto the surface 32 of the substrate 30 is performed at elevated temperature, so that during deposition the material of the additive layer 38 interdiffuses into and with the material of the substrate 30, forming the diffusion zone 40. The diffusion zone 40, indicated by a dashed line in FIG. 2, is a part of the protective coating 36 but extends downward into the substrate 30.

The protective coating 36 has an outwardly facing protective-coating surface 42 remote from the surface 32 of the substrate 30. An alumina (aluminum oxide, or $Al_2O_3$) scale 44 forms at this protective-coating surface 42 by oxidation of the aluminum in the protective-coating 36 at the protective-coating surface 40. A ceramic thermal barrier coating 46 optionally overlies and contacts the protective-coating surface 42 and the alumina scale 44 thereon.

Figure 3:
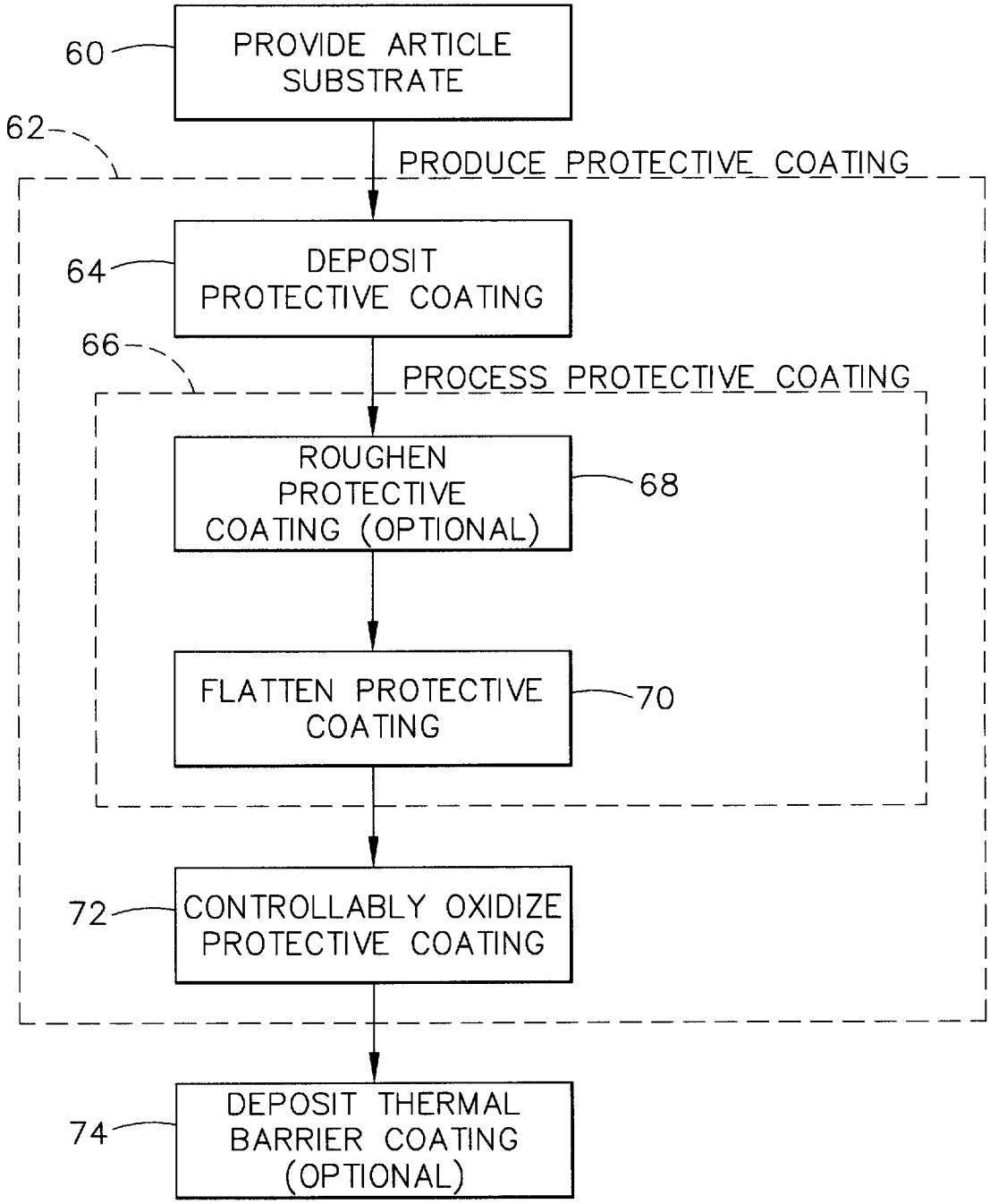
FIG. 3 is a block flow diagram of an approach for preparing a coated gas turbine airfoil.

FIG. 3 is a block flow diagram of a preferred approach for fabricating an article. An article and thence the substrate 30 are provided, numeral 60. The article is preferably a component of a gas turbine engine such as a gas turbine blade 20 or vane (or "nozzle", as the vane is sometimes called), see FIG. 1. The article may be a single crystal article, a preferentially oriented polycrystal, or a randomly oriented polycrystal. The article is most preferably made of a nickel-base superalloy. As used herein, "nickel-base" means that the composition has more nickel present than any other element. The nickel-base superalloys are typically of a composition that is strengthened by the precipitation of gamma-prime phase. The preferred nickel-base alloy has a composition, in weight percent, of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, from 0 to about 1.5 percent hafnium, balance nickel and incidental impurities.

A most preferred alloy composition is Rene' N5, which has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities. Other operable superalloys include, for example, Rene' N6, which has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium. about 0.05 percent carbon, about 0.004 percent boron, about 0.01 percent yttrium, balance nickel and incidental impurities; Rene 142, which has a nominal composition, in weight percent, of about 12 percent cobalt, about 6.8 percent chromium, about 1.5 percent molybdenum, about 4.9 percent tungsten, about 6.4 percent tantalum, about 6.2 percent aluminum, about 2.8 percent rhenium, about 1.5 percent hafnium, about 0.1 percent carbon, about 0.015 percent boron, balance nickel and incidental impurities; CMSX-4, which has a nominal composition in weight percent of about 9.60 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities; CMSX-10, which has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities; PWA1480, which has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities; PWA1484, which has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and MX-4, which has a nominal composition as set forth in U.S. Pat. 5,482,789, in weight percent, of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities. The use of the present invention is not limited to these preferred alloys, and has broader applicability.

A flattened protective coating 36 is produced on the surface 32 of the substrate 30, numeral 62. As part of this step 62, the protective coating 36 is deposited, numeral 64. The protective coating 36 is preferably a diffusion aluminide protective coating 36, produced by depositing an aluminum-containing layer onto the substrate 30 and interdiffusing the aluminum-containing layer with the substrate 30 to produce the additive layer 38 and the diffusion zone 40 shown in FIG. 2. The protective coating 36 may be a simple diffusion aluminide, or it may be a more complex diffusion aluminide wherein another layer, preferably platinum, is first deposited upon the surface 32, and the aluminum-containing layer is deposited over the first-deposited layer. In either case, the aluminum-containing layer may be doped with other elements that modify the protective coating 36. The basic application procedures for these various types of protective coatings 36 are known in the art, except for the modifications to the processing and structure discussed herein.

Because the platinum-aluminide diffusion aluminide is preferred, its deposition will be described in more detail. A platinum-containing layer is first deposited onto the surface 32 of the substrate 30. The platinum-containing layer is preferably deposited by electrodeposition. For the preferred platinum deposition, the deposition is accomplished by placing a platinum-containing solution into a deposition tank and depositing platinum from the solution onto the surface 32 of the substrate 30. An operable platinum-containing aqueous solution is $Pt(NH_3)_4HPO_4$ having a concentration of about 4–20 grams per liter of platinum, and the voltage/current source is operated at about ½–10 amperes per square foot of facing article surface. The platinum first coating layer, which is preferably from about 1 to about 6 micrometers thick and most preferably about 5 micrometers thick, is deposited in 1–4 hours at a temperature of 190–200° F.

A layer comprising aluminum and any modifying elements is deposited over the platinum-containing layer by any operable approach, with chemical vapor deposition preferred. In that approach, a hydrogen halide activator gas, such as hydrogen chloride, is contacted with aluminum metal or an aluminum alloy to form the corresponding aluminum halide gas. Halides of any modifying elements are formed by the same technique. The aluminum halide (or mixture of aluminum halide and halide of the modifying element, if any) contacts the platinum-containing layer that overlies the substrate 30, depositing the aluminum thereon. The deposition occurs at elevated temperature such as from about 1825° F. to about 1975° F. so that the deposited aluminum atoms interdiffuse into the substrate 30 during a 4 to 20 hour cycle.

The protective coating is processed to achieve a flattened protective-coating surface 42, numeral 66. Optionally, as part of step 66, the protective-coating surface 42 is roughened, numeral 68. The roughening 68 acts over the entire surface 42 in a generally uniform manner to reduce, and ideally remove, surface concentration gradients in the major elements such as nickel, aluminum, and platinum. The roughening 68 also aids in cleaning any residue and oxide films from the surface 42 in preparation for the subsequent processing. Roughening is preferably accomplished by grit blasting the protective-coating surface 42. The grit blasting preferably uses alumina grit having a grit classification of from about #60 to about #1200, with a preferred grit classification of #80. The grit blasting uses a pressure of from about 30 to about 100 pounds per square inch, preferably from about 60 to about 80 pounds per square inch. Testing has shown that grit blasting with a #60 to #320 grit at 80 pounds per square inch provides the most effective reduction in concentration gradients, cleaning, and removal of oxides at the surface of the protective coating. The grit blasting with grit in this range of about #60 to about #320 grit is a coarse grit blasting, which removes up to about 2 micrometers of material from the surface and aids in achieving uniform and "clean" surface chemistry. Fine grit blasting with grit in the #320–#1200 range may also be employed, but such fine grit blasting has a lesser effect in achieving chemical homogenization of the surface of the protective coating.

As part of the processing step 66, the protective coating 36 is flattened, numeral 70. The flattening is achieved using an approach that does not remove a substantial amount of metal from the surface 42 of the protective coating 36, instead achieving flattening through plastic deformation of the material at the surface 42.

Figure 4:
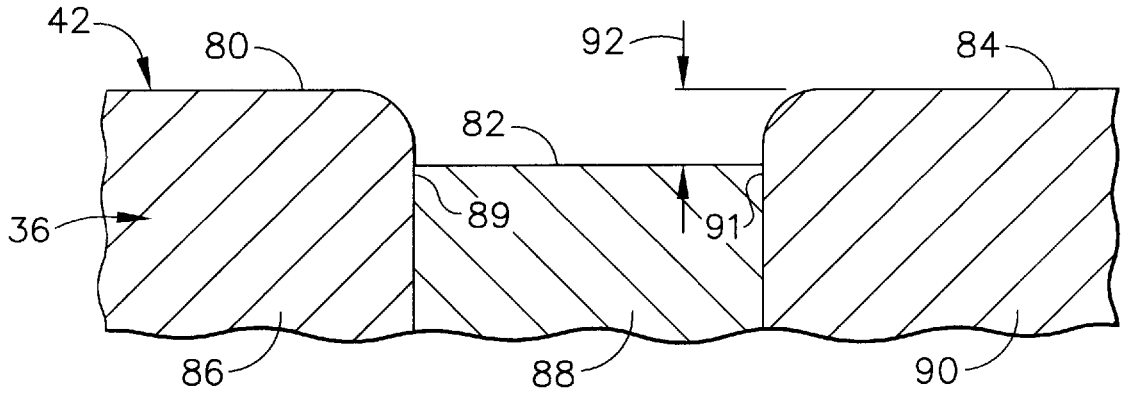
FIG. 4 is a schematic detail of the surface of the bond coat, taken in region 4 of FIG. 2 but without the alumina scale present, prior to flattening the surface.
Figure 5:
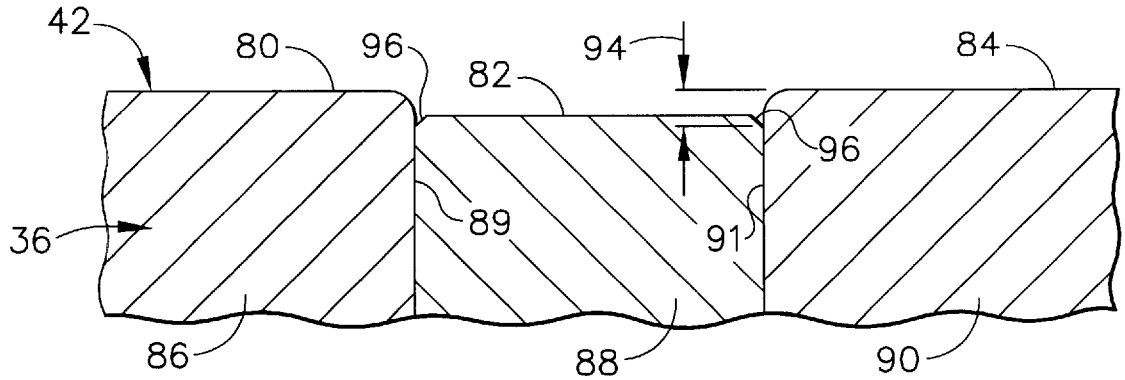
FIG. 5 is a schematic detail of the surface of the bond coat similar to that of FIG. 4, but after flattening of the surface.

FIGS. 4–5 illustrate the meaning of "flattening" as used herein. The surface 42 of the protective coating 36 is not perfectly flat when viewed at high magnification in a sectioning plane perpendicular to the surface 42. Instead, as seen in FIG. 4, there is a local maximum vertical displacement (i.e., perpendicular to the surface 42) between the points on the surfaces of adjacent pairs of grains at the grain boundaries. For example, in FIG. 4 there is a vertical displacement between respective surfaces 80 and 82 of neighboring grains 86 and 88 at a grain boundary 89, and another vertical displacement between respective surfaces 82 and 84 of neighboring grains 88 and 90 at a grain boundary 91. This vertical displacement is an initial grain boundary displacement height 92. The initial average magnitude of the grain boundary displacement height 92 for a diffusion aluminide protective coating is typically on the order of about 5 micrometers. This magnitude of the grain boundary displacement height leads to a failure mechanism of the alumina scale 44 during subsequent service termed ratcheting that produces convolutions in the alumina scale 44 in the neighborhood of the grain boundaries 89 and 91.

According to the present approach, the magnitude of the initial grain boundary displacement height 92 is reduced to a maximum final grain boundary displacement height 94 as illustrated in FIG. 5 by the processing 66. There may be slight grooves 96 at the intersections of the grain boundaries 89 and 91 with the surface 42. The final grain boundary displacement height 94 is measured to the bottoms of the grooves 96, where present, or to the grain surface 82 where no grooves 96 are present. Where the surfaces 82 and 84 are at the same height and there is a groove 96 present, the grain boundary displacement height 94 is measured from the bottom of the groove 96 to either the surface 82 or the surface 84. Where the surfaces 82 and 84 are at the same height and there are no grooves 96 present, the grain boundary displacement height 94 is zero. The average final grain boundary displacement height 94 is less than about 3 micrometers, more preferably less than about 1 micrometer, and most preferably less than about 0.5 micrometer to suppress the incidence of the convolution/ratcheting failure mechanism. Achieving these grain boundary displacement heights 94 over 40 percent or more of the grain boundaries results in improvement in the service life of the protective coating, although it is preferred that the indicated grain boundary displacement heights 94 are achieved over all of the grain boundaries. It is further preferred that at least about 40 percent, and more preferably all, of the surface of the protective coating has a grain displacement height of less than about 3 micrometers, more preferably less than about 1 micrometer, more preferably less than about 0.5 micrometer to suppress failure initiating at locations away from the grain boundaries.

The grain boundary displacement height is determined in an enlarged sectional view like that of FIG. 5, taken in a plane perpendicular to the protective-coating surface 42 and measured across the locations where grain boundaries in the protective coating 36 intersect the protective-coating surface 42. This reduction in the average grain boundary displacement height reduces the severity of, and extends the time of the onset of, the thermal cycling deformation convolution mechanism that leads to failure of the alumina scale 44.

The processing 66 (i.e., flattening) without removal of metal is preferably accomplished by peening (sometimes termed "shot peening"). In this technique, the surface 42 of the protective coating 36 is impacted with a flow of a shot made of a material that is hard relative to the protective coating 36, so that the protective coating 36 is deformed. The peening has the effect of mechanically smashing down the high points of the surface 42 of the protective coating 36, so that the surface is flattened but little if any metal is removed from the surface. The preferred peening approach is to peen the surface 42 with zirconia or stainless steel shot with an intensity of from about 6A to about 12A for a typical aluminum-based protective coating 36, but depending upon the hardness of the protective coating 36. If the peening intensity is lower than this range, there is insufficient plastic deformation to achieve the flattening. If the peening intensity is higher than this range, there may be cracking or other damage to the protective coating 36 or to the underlying substrate 30. Optionally, the peened article may be heat treated after peening, to either stress relieve or recrystallize the protective coating 36. A stress-relief heat treatment may be achieved at 1925° F. in two hours. A recrystallize heat treatment may be achieved at 2050° F. in two hours.

After the processing 66, the protective-coating surface 42 is exposed to an environment wherein the protective-coating surface is controllably oxidized to form the alumina scale 44, numeral 72. The parameters of the oxidation treatment are controlled to produce the desired thin, pure alumina scale 44. The controlled parameters include the partial pressure of oxygen, the temperature range of the preoxidation treatment 72, the heating rate to the pre-oxidation temperature, and the time of the pre-oxidation treatment.

To form the desired alumina scale 44, the partial pressure of oxygen is preferably between about $10^{-5}$ mbar (millibar) and about $10^{3}$ mbar, more preferably between about $10^{-5}$ mbar and about $10^{-2}$ mbar. Most preferably, the partial pressure of oxygen is about $10^{-4}$ mbar, which produces the best thermal fatigue life in furnace cycle testing. The pre-oxidation step 68 is performed without combustion gas or other sources of corrodants present, which otherwise interfere with the formation of the desired high-purity alumina scale 44. The pre-oxidation temperature is preferably from about 1800° F. to about 2100° F., most preferably from about 2000° F. to about 2100° F. The higher pre-oxidation temperatures are preferred to favor the formation of alpha alumina, but the indicated maximum temperature may not be exceeded due to the potential for damage of the superalloy substrate. The article to be pre-oxidized is desirably heated from room temperature to the pre-oxidation temperature in about 45 minutes or less, more preferably from about 15 to about 35 minutes. If the heating is too slow, there is an opportunity for the formation of detrimental, less adherent, oxide phases within the alumina scale 44. The adherence of the alumina scale 44 to the protective coating is therefore reduced. The time at the pre-oxidizing temperature is preferably from about ½ hour to about 3 hours, to achieve a pure alumina scale 44 having a thickness of from about 0.1 micrometer to about 1 micrometer.

If the pre-oxidation parameters lie outside these ranges, an alumina scale will be produced, but it will be less desirable than the alumina scale 44 produced by pre-oxidation within these ranges. Comparative microanalysis (scanning electron microscope and XPS) of alumina scale produced using the indicated pre-oxidation parameters and alumina scale produced outside the indicated pre-oxidation parameters disclosed variations in the nature of the alumina scale. Non-uniform microstructures and finer alumina grain sizes resulted when the pre-oxidation pressure was greater than about $10^{-4}$ mbar. The non-uniformity increased when other elements than aluminum and oxygen were present in the alumina scale. Oxygen pressures within the range of from about $10^{-5}$ mbar to about $10^{3}$ mbar yielded desirable "ridge" type microstructures characteristic of alpha alumina when no elements other than aluminum and oxygen were present in the oxide. Low partial pressures of oxygen, below about $10^{-5}$ mbar, result in internal oxidation along with an outward diffusion of aluninum. Such a structure has reduced adhesion to the protective coating 36.

Optionally but preferably, the thermal barrier coating 46 is deposited overlying the flattened and oxidized protective-coating surface 42 and the alumina scale 44 that has formed thereon, numeral 74. The optional ceramic thermal barrier coating 46, where present, is preferably from about 0.003 to about 0.010 inch thick, most preferably about 0.005 inch thick. The ceramic thermal barrier coating 46 is preferably yttria-stabilized zirconia, which is zirconium oxide containing from about 2 to about 12 weight percent, preferably from about 4 to about 8 weight percent, of yttrium oxide. Other operable ceramic materials may be used as well. The ceramic thermal barrier coating 46 may be deposited by any operable technique, such as electron beam physical vapor deposition or plasma spray.

The flattening of the protective coating and the controllable oxidizing of the protective coating to produce the alumina scale 44 must be employed together in the present invention. The flattening of the protective-coating surface 42 reduces the tendency of the protective coating 36 to form the convolutions by a ratcheting mechanism that lead to spalling of the alumina that forms on the protective-coating surface 42. The controlled oxidation of the protective-coating surface improves the bond strength between the protective coating and the alumina scale, and also slows the growth of the alumina scale. By forming the alumina scale by a controlled oxidation, the slow-growing alumina scale 44 is formed, which reduces stresses posed at the alumina scale 44/protective coating 36 interface. This, in turn, delays the start of the delamination failures. Thus, both mechanisms of failure are addressed and their tendency to cause early failure is suppressed. Suppressing only one of the failure mechanisms may have some beneficial effect, but not as much beneficial effect as when the two failure mechanisms are treated together as here.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of fabricating an article protected by a protective coating system, comprising the steps of providing an article substrate having a substrate surface; and thereafter producing a protective coating having a flattened, pre-oxidized protective-coating surface on the substrate surface, the step of producing the protective coating including the steps of depositing a protective coating on the substrate surface, the protective coating having a protective-coating surface, processing the protective coating to achieve a flattened protective-coating surface, wherein the step of processing the protective coating includes the steps of roughening the protective-coating surface, and thereafter flattening the protective-coating surface, and controllably oxidizing the protective-coating surface.

2. The method of claim 1, wherein the step of providing the article substrate includes the step of providing the article substrate comprising a nickel-base superalloy.

3. The method of claim 1, wherein the step of providing the article substrate includes the step of providing the article substrate comprising a component of a gas turbine engine.

4. The method of claim 1, wherein the step of depositing the protective coating includes the step of depositing a diffusion aluminide protective coating.

5. The method of claim 1, wherein the step of depositing the protective coating includes the step of depositing a platinum aluminide protective coating.

6. The method of claim 1, wherein the step of roughening the protective-coating surface includes the step of grit blasting the protective-coating surface.

7. The method of claim 1, wherein the step of roughening the protective-coating surface includes the step of grit blasting the protective-coating surface with grit having a grit classification of from about #60 to about #1200.

8. The method of claim 1, wherein the step of flattening the protective-coating surface includes the step of peening the protective-coating surface.

9. The method of claim 1, wherein the step of flattening the protective coating includes the step of peening the bond coat with a peening intensity of from about 6A to about 12A.

10. The method of claim 1, wherein the step of processing the protective coating includes the step of flattening the protective-coating surface without removing metal from the protective-coating surface.

11. The method of claim 1, wherein the step of processing the protective coating includes the step of peening the protective coating.

12. A method of fabricating an article protected by a protective coating system, comprising the steps of providing an article substrate having a substrate surface; and thereafter producing a protective coating having a flattened, pre-oxidized protective-coating surface on the substrate surface, the step of producing the protective coating including the steps of depositing a protective coating on the substrate surface, the protective coating having a protective-coating surface, processing the protective coating to achieve a flattened protective-coating surface, wherein the steps of depositing the protective coating and processing the protective coating are performed concurrently, and controllably oxidizing the protective-coating surface.

13. The method of claim 1, wherein the step of processing the protective coating is performed after the step of depositing the protective coating.

14. The method of claim 1, wherein the step of processing the protective coating includes the step of processing the protective coating to achieve a flattened protective-coating surface over at least about 40 percent of grain boundaries of the protective coating.

15. A method of fabricating an article protected by a protective coating system, comprising the steps of providing an article substrate having a substrate surface; and thereafter producing a protective coating having a flattened, pre-oxidized protective-coating surface on the substrate surface, the step of producing the protective coating including the steps of depositing a protective coating on the substrate surface, the protective coating having a protective-coating surface, processing the protective coating to achieve a flattened protective-coating surface, wherein the step of processing the protective coating includes the step of producing a protective-coating surface wherein an average grain boundary displacement height is less than about 3 micrometers, and controllably oxidizing the protective-coating surface, wherein the step of controllably oxidizing the protective-coating surface includes the step of heating the protective coating in an atmosphere having a partial pressure of oxygen of from about $10^{-5}$ mbar to about $10^{3}$ mbar.

16. A method of fabricating an article protected by a protective coating system, comprising the steps of providing an article substrate having a substrate surface; and thereafter producing a protective coating having a flattened, pre-oxidized protective-coating surface on the substrate surface, the step of producing the protective coating including the steps of depositing a protective coating on the substrate surface, the protective coating having a protective-coating surface, processing the protective coating to achieve a flattened protective-coating surface, and controllably oxidizing the protective-coating surface, wherein the step of controllably oxidizing the protective-coating surface includes the step of heating the protective coating in an atmosphere having a partial pressure of oxygen of from about $10^{-5}$ mbar to about $10^{3}$ mbar.

17. The method of claim 16, wherein the step of controllably oxidizing the protective-coating surface includes the step of heating the protective coating in an atmosphere having a partial pressure of oxygen of from about $10^{-5}$ mbar to about $10^{-2}$ mbar.

18. The method of claim 16, wherein the step of controllably oxidizing the protective-coating surface includes the step of heating the protective coating in an atmosphere having a partial pressure of oxygen of bout $10^{-4}$ mbar.

19. The method of claim 1, wherein the step of controbally oxidizing the protective-coating surface includes the step of heating the protective coating to an oxidizing temperature of from about 1800° F. to about 2100° F.

20. The method of claim 1, wherein the step of controllably oxidizing the protective-coating surface includes the step of heating the protective coating at an oxidizing temperature for a time of from about ½ hour to about 3 hours.

21. A method of fabricating an article protected by a protective coating system, comprising the steps of providing an article substrate having a substrate surface; and thereafter producing a protective coating having a flattened, pre-oxidized protective-coating surface on the substrate surface, the step of producing the protective coating including the steps of depositing a protective coating on the substrate surface, the protective coating having a protective-coating surface, processing the protective coating to achieve a flattened protective-coating surface, and controllably oxidizing the protective-coating surface, wherein the step of controllably oxidizing the protective-coating surface includes the step of heating the protective coating to a temperature of from about 2000° F. to about 2100° F., for a time of from about ½ hour to about 3 hours, and in an atmosphere having a partial pressure of oxygen of about $10^{-4}$ mbar.

22. The method of claim 1, including an additional step, after the step of processing the protective coating, of depositing a thermal barrier coating overlying the flattened, pre-oxidized protective-coating surface.

* * * * *